US008351627B2

(12) United States Patent
Chan et al.

(10) Patent No.: US 8,351,627 B2
(45) Date of Patent: Jan. 8, 2013

(54) HEARING AID WITH AN IDENTIFIER

(75) Inventors: Mo Choong Marie Chan, Singapore (SG); Uwe Flaig, Feucht (DE); Holger Kral, Fürth (DE); Martin Segerud, Erlangen (DE); Wee Hiong Tan, Singapore (SG); Ju Lin Teo, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 198 days.

(21) Appl. No.: 12/857,829

(22) Filed: Aug. 17, 2010

(65) Prior Publication Data

US 2011/0038499 A1 Feb. 17, 2011

(30) Foreign Application Priority Data

Aug. 17, 2009 (DE) ..... 10 2009 037 690

(51) Int. Cl.
*H04R 25/00* (2006.01)

(52) U.S. Cl. ..... 381/322; 381/324

(58) Field of Classification Search ..... 381/322, 381/324; 181/129, 130, 135
See application file for complete search history.

(56) References Cited

U.S. PATENT DOCUMENTS

| | | | |
|---|---|---|---|
| 4,638,125 | A | 1/1987 | Buettner |
| 6,480,528 | B1 | 11/2002 | Patel et al. |
| 6,813,364 | B1 | 11/2004 | Vonlanthen |
| 2003/0156726 | A1 | 8/2003 | Morales et al. |
| 2008/0044047 | A1 | 2/2008 | Kral et al. |

FOREIGN PATENT DOCUMENTS

| | | | |
|---|---|---|---|
| EP | 0238887 | A1 | 9/1987 |
| EP | 1190522 | A1 | 3/2002 |
| EP | 1890522 | A2 | 2/2008 |
| WO | 0079835 | A1 | 12/2000 |

*Primary Examiner* — Jeremy Luks
(74) *Attorney, Agent, or Firm* — Lawrence A. Greenberg; Werner H. Stemer; Ralph E. Locher

(57) ABSTRACT

A hearing aid includes an identifier for identifying usage of the hearing aid at a correct side on the left ear or the right ear of a wearer. The identifier is constructed as a rotational element having a first feature and a second feature to be respectively set by a rotational movement.

11 Claims, 1 Drawing Sheet

HEARING AID WITH AN IDENTIFIER

CROSS-REFERENCE TO RELATED APPLICATION

This application claims the priority, under 35 U.S.C. §119, of German Patent Application DE 10 2009 037 690.9, filed Aug. 17, 2009; the prior application is herewith incorporated by reference in its entirety.

BACKGROUND OF THE INVENTION

Field of the Invention

The invention relates to a hearing aid with an identifier for identifying whether or not the hearing aid is being used on the correct side on the left ear or the right ear of a wearer.

Hearing aids are portable hearing devices used to support the hard of hearing. In order to accommodate numerous individual requirements, different types of hearing aids are provided, e.g. behind-the-ear (BTE) hearing aids, hearing aids with an external receiver (receiver in the canal [RIC]) and in-the-ear (ITE) hearing aids, for example concha hearing aids or canal hearing aids (ITE, CIC) as well. The hearing aids listed in an exemplary manner are worn on the concha or in the auditory canal. Furthermore, bone conduction hearing aids, implantable or vibrotactile hearing aids are also commercially available. In that case, a damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually constructed as an electroacoustic transducer, e.g. a miniaturized loudspeaker, or as an electromechanical transducer, e.g. a bone conduction receiver. The amplifier is usually integrated into a signal-processing configuration.

The left and the right hearing aid can be adjusted individually to the requirements of the wearer in the case of patients requiring a double supply, that is to say one respective hearing aid is needed in each of the left and the right ear.

It is customary for the hearing aids to be provided with an identification element visible from the outside, e.g. a colored identification plate, in such a way that the wearer can distinguish between the hearing aids which usually have identical constructions with, for example, a blue identification plate representing the left hearing aid and a red identification plate representing the right hearing aid.

European Patent Application EP 1 190 522 A2 has disclosed a hearing aid with an identifier, in which the identifier is constructed as an identification plate. In that case, the identification plate has a rectangular construction and is provided for insertion into a housing of the hearing aid.

A disadvantage of the known hearing aid is that an additional part is required in each case for labeling the hearing aid. Since it is not known in advance whether the hearing aid will be used on the left ear of the wearer or on the right ear of the wearer, two parts are enclosed with the hearing aid in each case. In order to change the label of a hearing aid, the enclosed additional part must be fitted into the hearing aid. In some circumstances, a neutral original cover must still be removed in advance in the process.

SUMMARY OF THE INVENTION

It is accordingly an object of the invention to provide a hearing aid with an identifier, which overcomes the hereinafore-mentioned disadvantages of the heretofore-known devices of this general type and which has a simpler structure for the labeling of a left ear or a right ear.

With the foregoing and other objects in view there is provided, in accordance with the invention, a hearing aid, comprising an identifier for identifying usage of the hearing aid at a correct side on the left ear or the right ear of a wearer. The identifier is constructed as a rotational element having a first feature and a second feature to be set by a rotational movement. The rotational element is preferably an inherent part of the hearing aid and can be adjusted by a rotational movement, preferably through half a rotation, from the first feature, which implies use on the left ear, to the second feature, which implies use on the right ear.

In accordance with another feature of the invention, it is expedient for the rotational element to have a cylindrical construction. A cylindrical element can advantageously be plugged into a corresponding recess or opening in such a way that the element is mounted and can be rotated at the same time. A cylindrical rotational element which, for example, has the shape of a tablet, could be provided with red color on one half and blue color on the other half, with the diameter line of the tablet marking the boundary between blue and red. Furthermore, this tablet could have a contact or engagement, for example for a screwdriver, for imparting a rotational movement onto the tablet. This tablet could thereupon be attached in a housing of an e.g. behind-the-ear hearing aid in such a way that it is visible from the outside.

In accordance with a further feature of the invention, it is expedient in this case for the rotational element to have a first region for visualizing the first feature and a second region for visualizing the second feature.

In accordance with an added feature of the invention, the rotational element has a latching device, which is constructed to bring about latching in a first position or in a second position, wherein the positions can be reached by the rotational movement. In the case of a cylindrical rotational element, the latching device could preferably be formed in the lateral surface of the cylinder parallel to an axis of symmetry of the cylinder.

In accordance with an additional, alternative feature of the invention, the rotational element has a multipart construction. By way of example, the rotational element includes a cylindrical main part constructed for holding a first part, which constitutes the first region, and a second part, which constitutes the second region. Combined into one unit, the main part, the first part and the second part form the cylindrical pin-like rotational element.

In accordance with yet another, alternative feature of the invention, the rotational element has an integral or one-piece construction. By way of example, in the case of the integral construction, one end face of the rotational element is provided with the first feature and the second feature.

In accordance with yet a further feature of the invention, the rotational element is preferably disposed in a cover for a housing. In hearing aids, covers of the housings are, for example, used as battery compartment lids, and the hearing aid is switched off by opening the battery compartment lid. If the rotational element is disposed within the battery compartment lid, a user can identify the element when the battery compartment lid is open and, when the hearing aid is picked up from a resting place, the battery compartment lid can be closed in order to operate the hearing aid and the wearer of the hearing aid can directly afterward place the hearing aid onto the respective ear on the correct side.

In accordance with yet an added, optimized feature of the invention, the rotational element is constructed as a rotational axle for the cover, wherein the cover is mounted on the housing in such a way that it can pivot through the use of the rotational element. A synergistic effect is achieved by the interaction of the rotational element firstly as an identifier and secondly as part of a hinge. Thus, the technical effect is the display of a feature for identifying whether the hearing aid is used on the correct side on the left or the right ear of a wearer, with simultaneous mechanical use of the rotational element for a construction-dependent housing with a cover.

In accordance with yet an additional, alternative feature of the invention, the rotational element is constructed as a locking device for locking the cover to the housing after reaching a closed position.

In accordance with again another feature of the invention, the cover or the housing is preferably provided with an indicator opening, which is constructed to display only one of the features in each case.

In accordance with a concomitant feature of the invention, in the variant in which the rotational element is constructed as a rotational axle for a flap, a cover or any other part that can pivot on the housing, the housing has a receptacle for holding the rotational axle and the receptacle is constructed to display only one of the features in each case through the use of an indicator opening.

Other features which are considered as characteristic for the invention are set forth in the appended claims.

Although the invention is illustrated and described herein as embodied in a hearing aid with an identifier, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
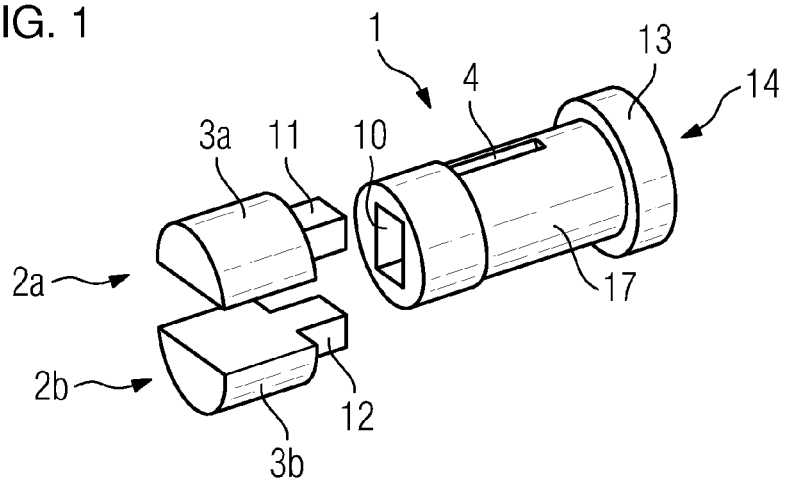
FIG. 1 is a diagrammatic, exploded, perspective view of a multipart rotational element.

Referring now to the figures of the drawings in detail and first, particularly, to FIG. 1 thereof, there is seen a rotational element 1 with a main part 17, a first region 3*a* which forms a first part, and a second region 3*b* which forms a second part. A seat or fitting 10 for the main part 17 is provided on a lower part. The seat or fitting 10 is constructed in a rectangular fashion as a blind hole in the interior of the cylindrical main part 17. The first part 3*a* and the second part 3*b* correspondingly have a semi-cylindrical construction and are respectively provided at a first end thereof with a first pin 11 and a second pin 12.

If the first part 3*a* and the second part 3*b* are placed congruently above one another, they in turn form a cylindrical element, whereas the first pin 11 and the second pin 12 form a larger rectangular pin. The dimensions of this larger pin are selected in such a way that it can be inserted into the seat or fitting 10 in a precise fashion. Since the seat or fitting 10 is a press seat or fitting, pressing the first pin 11 and the second pin 12 into the seat or fitting 10 results in a secure mechanical hold.

The first part and the second part, that is to say the first region 3*a* and the second region 3*b*, basically have the same shape. They differ by having different colors, for example blue and red, for forming a first feature 2*a* and a second feature 2*b*.

The rotational element 1 could also have an integral or one-piece construction. In this case, one end face of the cylindrical rotational element would have blue color on one half and red color on the other half.

There is a latching device 4 in a lateral surface of the main part 17 parallel to an axis of symmetry of the main part 17. The latching device 4 is constructed as an elongate recess. In the case of a rotational movement of the rotational element 1, the elongate recess can latch into an appropriately disposed latching lug when a first position is reached and hence latching is ensured in this position.

Figure 2:
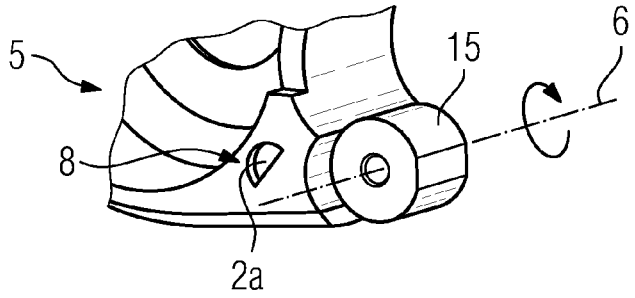
FIG. 2 is a fragmentary, enlarged, perspective view of a cover with an indicator opening.

FIG. 2 shows a section of a cover 5, preferably a battery compartment cover. The cover 5 has a hinge part 15 for engaging into an appropriately constructed further hinge part of a hearing aid housing. A first option and a second option are available when the rotational element 1 is disposed in the cover 5.

In the case of the first option, the structural unit of the cover 5 has an indicator opening 8. The indicator opening 8 has a crescent-shaped opening on an outer side of the cover 5. This crescent-shaped opening serves for displaying only a respective one of the features 2*a*, 2*b* of the rotational device 1. The indicator opening 8 forms an end of a bore introduced into the cover 5. The rotational element 1 can be plugged into the bore in such a way that it is mounted in a rotational fashion and, when rotated from a first position to a second position, the first feature 2*a* or the second feature 2*b* can be seen in each case through the indicator opening 8. An advantage of this embodiment is that, when the battery compartment lid is closed, the respectively colored features 2*a*, 2*b* do not interrupt an aesthetically constructed outer contour of the hearing aid. For example, the surface of the hearing aid can be completely embodied in skin color, and a colored point would not have a negative effect on the outer surface because the point could only be identified when the battery compartment lid is opened.

The hinge part 15 has a further bore with a rotational axle 6. The rotational axle is illustrated in a dashed-dotted fashion and a rotation arrow is symbolically drawn in a curved fashion.

Figure 3:
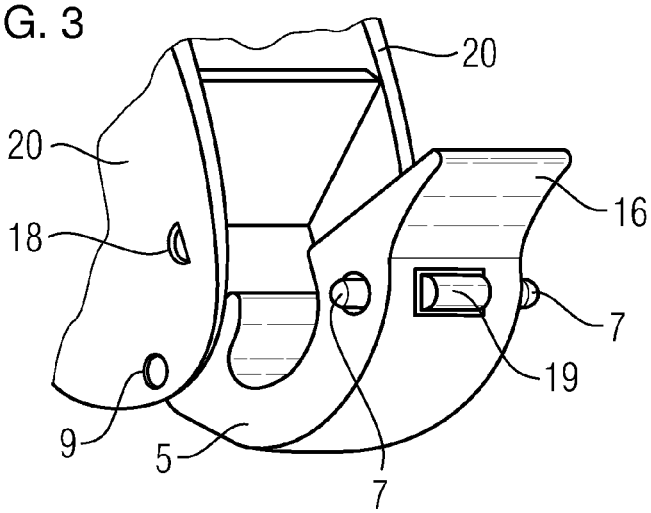
FIG. 3 is a fragmentary, perspective view of a portion of a hearing aid wherein, basically, a part of the hearing aid with a battery compartment is illustrated.

FIG. 3 shows the battery compartment cover or lid of FIG. 2 fitted into a housing 20. If the rotational element 1 is constructed as the rotational axle 6 for the cover 5 and the cover 5 is mounted on the housing in such a way that it can pivot as a result of the rotational element 1, this embodiment implements the second option.

The housing 20 has diametrically opposite receptacles 9 for holding the rotational element 1, which simultaneously forms the rotational axle 6. This receptacle 9 can also be constructed as an indicator opening 8, but in this embodiment variant a latching device 18 is preferably constructed as an indicator opening 8. In this case, the latching device 18 is constructed as a crescent-shaped opening for a locking device 7 of the cover 5. In this application, the rotational element 1 forms the locking device 7 for locking the cover 5 to the housing 20 after reaching a closed position. The locking device 7 is constructed as a rod, which can be rotated from a first position for displaying the first feature 2*a* to a second position for displaying the second feature 2*b*.

The invention claimed is:

1. A hearing aid, comprising:

an identifier for identifying usage of the hearing aid at a correct side on the left ear or the right ear of a wearer, said identifier being constructed as a rotational element having a first feature and a second feature to be set by a rotational movement; and a housing having a cover, said rotational element being disposed in said cover;

wherein said rotational element is constructed as a locking device for locking said cover to said housing after reaching a closed position.

2. The hearing aid according to claim 1, wherein said rotational element has a cylindrical construction.

3. The hearing aid according to claim 1, wherein said rotational element has a first region for visualizing said first feature and a second region for visualizing said second feature.

4. The hearing aid according to claim 1, wherein said rotational element has a latching device configured to bring about latching in a first position or in a second position to be reached by said rotational movement.

5. The hearing aid according to claim 1, wherein said rotational element has a multipart construction.

6. The hearing aid according to claim 1, wherein said rotational element has an integral construction.

7. The hearing aid according to claim 1, wherein said rotational element has a one-piece construction.

8. The hearing aid according to claim 1, wherein said rotational element is constructed as a rotational axle for said cover, and said cover is mounted on said housing for pivoting said cover by said rotational element.

9. The hearing aid according to claim 1, wherein said cover has an indicator opening configured to display only a respective one of said features.

10. The hearing aid according to claim 8, wherein said housing has a receptacle for holding said rotational axis and said receptacle is configured to display only a respective one of said features through an indicator opening.

11. A hearing aid, comprising:

an identifier for identifying usage of the hearing aid at a correct side on the left ear or the right ear of a wearer, said identifier being constructed as a rotational element having a first feature and a second feature to be set by a rotational movement; and a housing having a cover, said rotational element being disposed in said cover;

wherein said rotational element is constructed as a rotational axle for said cover, and said cover is mounted on said housing for pivoting said cover by said rotational element; and wherein said cover is constructed as a battery compartment for inserting a battery.

* * * * *